US007342358B2

(12) United States Patent
Iwase

(10) Patent No.: US 7,342,358 B2
(45) Date of Patent: Mar. 11, 2008

(54) PLASMA DISPLAY PANEL

(75) Inventor: Nobuhiro Iwase, Miyazaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 187 days.

(21) Appl. No.: 11/353,248

(22) Filed: Feb. 14, 2006

(65) Prior Publication Data

US 2006/0192488 A1 Aug. 31, 2006

(30) Foreign Application Priority Data

Feb. 14, 2005 (JP) ..... 2005-036427

(51) Int. Cl.
*H01J 17/49* (2006.01)

(52) U.S. Cl. ..... 313/582; 313/584

(58) Field of Classification Search ..... 313/581–587
See application file for complete search history.

(56) References Cited

U.S. PATENT DOCUMENTS 6,450,849 B1 9/2002 Harada
7,102,286 B2 9/2006 Shibata et al.
2003/0197468 A1 10/2003 Shibata et al.

FOREIGN PATENT DOCUMENTS

| | | |
|---|---|---|
| JP | 2000-21304 | 1/2000 |
| JP | 2001-222958 | 8/2001 |
| JP | 2003-308784 | 10/2003 |
| KR | 2003-0083564 | 10/2003 |

OTHER PUBLICATIONS

Korean Patent Office Action, mailed Mar. 28, 2007 and issued in corresponding Korean Patent Application No. 10-2006-0005669.

*Primary Examiner*—Vip Patel
(74) *Attorney, Agent, or Firm*—Staas & Halsey LLP

(57) ABSTRACT

A plasma display panel includes an insulation layer for covering a plurality of row electrodes arranged on a first substrate. A surface of the insulation layer is an uneven surface that reflects irregularities of a foundation surface. At least a surface layer portion of the insulation layer is made up of crystals of an insulation material. A top surface of a partition that is arranged on a second substrate and abuts against the insulation layer is formed to extend with respect to a projection of the insulation layer that abuts against the partition at a distance greater than a height of the projection.

6 Claims, 5 Drawing Sheets

PLASMA DISPLAY PANEL

BACKGROUND OF THE INVENTION

1. Field of the Invention

The present invention relates to plasma display panels including crystalline films that are formed to cover uneven surfaces and are exposed to discharge gas spaces.

2. Description of the Related Art

An AC type plasma display panel includes a dielectric layer for covering display electrodes. The dielectric layer is formed on a substrate on which the display electrodes are arranged in a manner to extend over the entire screen. The dielectric layer that is made of low melting point glass, which is a general material, has a thickness of approximately 20 μm to 30 μm. A protection film is deposited on a surface of the dielectric layer. The protection film has a thickness of approximately 0.5 μm to 1 μm and serves to prevent sputtering due to discharges for the dielectric layer. Stated differently, the display electrodes are covered with a layered film including the dielectric layer and the protection film for a discharge gas space. The layered film including the dielectric layer and the protection film is herein referred to as an insulation layer.

Magnesium oxide (magnesia: MgO) is used as a material for the protection film. Magnesia is an insulation material having a high secondary electron emission coefficient. The protection film made from magnesia is exposed to the discharge gas space. Thereby, a discharge starting voltage is reduced, which facilitates generation of discharges. A vacuum deposition method, which is a proven method industrially, is used for forming the protection film made from magnesia.

A vapor deposition method (also called a vapor growth method) has recently received attention as a method for forming dielectric layers. Japanese unexamined patent publication No. 2000-21304 describes forming a dielectric layer made from silicon dioxide or organic silicon oxide using plasma CVD (Chemical Vapor Deposition) that is one kind of chemical vapor deposition method. The vapor deposition method enables provision of a thin dielectric layer having a uniform thickness. Further, the vapor deposition method makes it possible to form a dielectric layer with a low relative dielectric constant that is favorable to reduction of interelectrode capacitance at temperatures lower than a burning temperature of low melting point glass.

Layers obtained by the vapor deposition method have a structural feature in which a surface is uneven due to reflection of irregularities of a foundation surface (a surface on which layers are formed). More specifically, surfaces of layers obtained by the vapor deposition method are not even unlike a surface of a low melting point glass layer that is burned at sufficiently high temperatures. A dielectric layer is formed on a substrate on which display electrodes are arranged. Accordingly, a dielectric layer obtained by the vapor deposition method has an uneven surface in which portions corresponding to the display electrodes bulge out compared to the other portions by amounts corresponding to the thickness of the display electrodes. Since a protection film formed on the uneven surface is sufficiently thin, the surface of the protection film, i.e., a surface of an insulation layer is similarly uneven.

Japanese unexamined patent publication No. 2003-308784 suggests using gaps provided by irregularities on an insulation layer surface as air passages for prompt replacement of the inside air and a discharge gas in the case of manufacture of plasma display panels. The patent publication describes an internal structure in which projections of the insulation layer on a first substrate abut against a mesh-patterned partition supported by a second substrate.

In plasma display panels in which insulation layers for covering electrodes have uneven surfaces, a problem arises that an operating life for enabling a desired display quality is short compared to plasma display panels in which insulation layers have even surfaces.

SUMMARY OF THE INVENTION

The present invention is directed to solve the problem pointed out above, and therefore, an object of the present invention is to extend an operating life of plasma display panels in which insulation layers for covering electrodes have uneven surfaces.

According to one aspect of the present invention, a plasma display panel includes a first substrate, a second substrate placed in face-to-face relation with the first substrate, a plurality of row electrodes arranged on the first substrate, and an insulation layer for covering the row electrodes. The insulation layer has an uneven surface that reflects irregularities of a foundation surface and at least a surface layer portion of the insulation layer is made up of crystals of an insulation material. In such a plasma display panel, a partition that abuts against the insulation layer is arranged on the second substrate, a top surface of the partition extends in a substrate surface direction with respect to a projection of the insulation layer that abuts against the partition, the top surface facing the insulation layer, and a distance of a part in the top surface of the partition is greater than a height difference between the projection of the insulation layer and vicinities of the projection, the part extending in the substrate surface direction with respect to the projection.

According to another aspect of the present invention, a plasma display panel is provided in which each of the row electrodes includes a ribbon-like power feeding trunk portion that continuously extends over an entire length of a corresponding row, a discharge portion that is made of a conductive film having a thickness smaller than that of the power feeding trunk portion and forms discharge surfaces in cells in the corresponding row and a power feeding branch portion that electrically connects the power feeding trunk portion to the discharge portion, a plurality of partitions that defines a boundary between adjacent columns is arranged on the second substrate, and in each of the row electrodes, the discharge portion has a thickness smaller than that of the power feeding trunk portion, the power feeding trunk portion is spaced from the discharge portion at a distance greater than a thickness of the insulation layer and the power feeding branch portion is placed to overlap with the partition in a plan view.

The present invention was made in light of the fact that "uneven parts of an insulation layer deteriorate significantly compared to the other parts" which was found through investigation of causes of the problems in conventional cases. In the present invention, for the purpose of reduction of sputtering for uneven parts of an insulation layer, a partition is arranged in a manner to narrow discharge gas spaces in the vicinity of uneven parts, or electrodes are arranged in a manner to distance discharges from uneven parts.

The present invention can extend an operating life of plasma display panels in which insulation layers for covering electrodes have uneven surfaces.

These and other characteristics and objects of the present invention will become more apparent by the following descriptions of preferred embodiments with reference to drawings.

DESCRIPTION OF THE PREFERRED EMBODIMENTS

The present invention is suitably applied to plasma display panels for color display. The following is a description of a case of a three-electrode surface discharge AC type plasma display panel having a screen including many cells.

Figure 1:
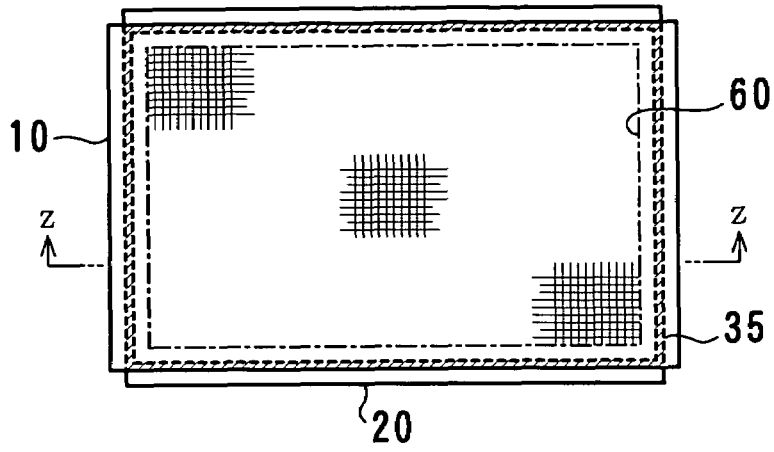
FIG. 1 is a front view showing the entire structure of a plasma display panel.
Figure 2:
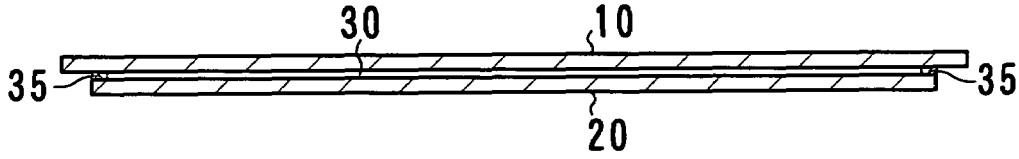
FIG. 2 is a cross-sectional cut along z-z line in FIG. 1.

A basic structure of a plasma display panel is shown in FIGS. 1 and 2 respectively. FIG. 1 is a front view showing the entire structure of the plasma display panel, and FIG. 2 is a cross-sectional cut along z-z line in FIG. 1. The plasma display panel includes a front panel 10, a rear panel 20 and a screen 60 made up of cells (light emission elements) arranged in a matrix. In the case where the screen 60 is a 42-inch diagonal, for example, the plasma display has dimensions of approximately 994 mm×585 mm. Each of the front panel 10 and the rear panel 20 is a structure including a glass substrate on which electrodes and other structural elements are fixed. Both the glass substrates have a size larger than the screen 60 and a thickness of approximately 3 mm. The front panel 10 and the rear panel 20 are positioned one above the other to assemble in face-to-face relation with each other. The front panel 10 and the rear panel 20 are bonded together with a sealing material 35 that has a frame shape in a plan view and is placed in the periphery of the area where the two panels overlap with each other. The front panel 10 projects over the rear panel 20 by approximately 5 mm in the lateral direction of FIG. 1. The rear panel 20 projects over the front panel 10 by approximately 5 mm in the vertical direction of FIG. 1. A flexible wiring board for electrical connection to a drive unit is joined to respective end portions of the front panel 10 and the rear panel 20 that project as described above. An internal space (a discharge gas space) 30 that is sealed by the front panel 10, the rear panel 20 and the sealing material 35 is filled with a discharge gas that is a mixture of neon and xenon. A thickness value (a dimension in the up-down direction of FIG. 2) of the discharge gas space 30 falls within the range of 100 μm through 200 μm.

Figure 3:
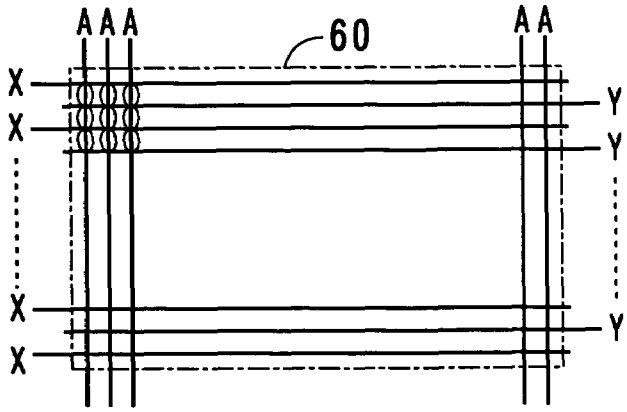
FIG. 3 is a schematic diagram showing an example of electrode arrangement.

An example of electrode arrangement is shown in FIG. 3. Referring to the illustrated electrode arrangement, row electrodes are arranged at regular intervals and such electrode arrangement is suitable for high-resolution display. On the screen 60 are arranged display electrodes X and display electrodes Y, both of which are row electrodes, and address electrodes that are column electrodes. The display electrodes X and the display electrodes Y are alternately arranged in the order of "X, Y, X, Y, . . . X, Y and X". Further, the display electrodes X and the display electrodes Y are arranged in parallel with each other. A set of a display electrode X and a display electrode Y adjacent thereto defines one row. Each of the display electrodes X and the display electrodes Y has relations with the neighboring two rows, except the display electrodes X placed at both ends of the arrangement. The total number of display electrodes X and display electrodes Y is a number determined by adding one to the number of rows of the screen 60. Each of the address electrodes is arranged in a manner to correspond to one column. The number of address electrodes is equal to the number of columns. The address electrodes and the display electrodes Y provide an electrode matrix for an addressing operation. Nine ellipses in FIG. 3 represent positions of cells that belong to a first column through a third column in each of a first, a second and a third rows.

The structure mentioned above is common to three embodiments described below. In all drawings including FIGS. 1-3 that are referred to in the following descriptions, corresponding structural elements in the embodiments are marked with the same reference symbols to reduce duplication of description.

First Embodiment

Figure 4:
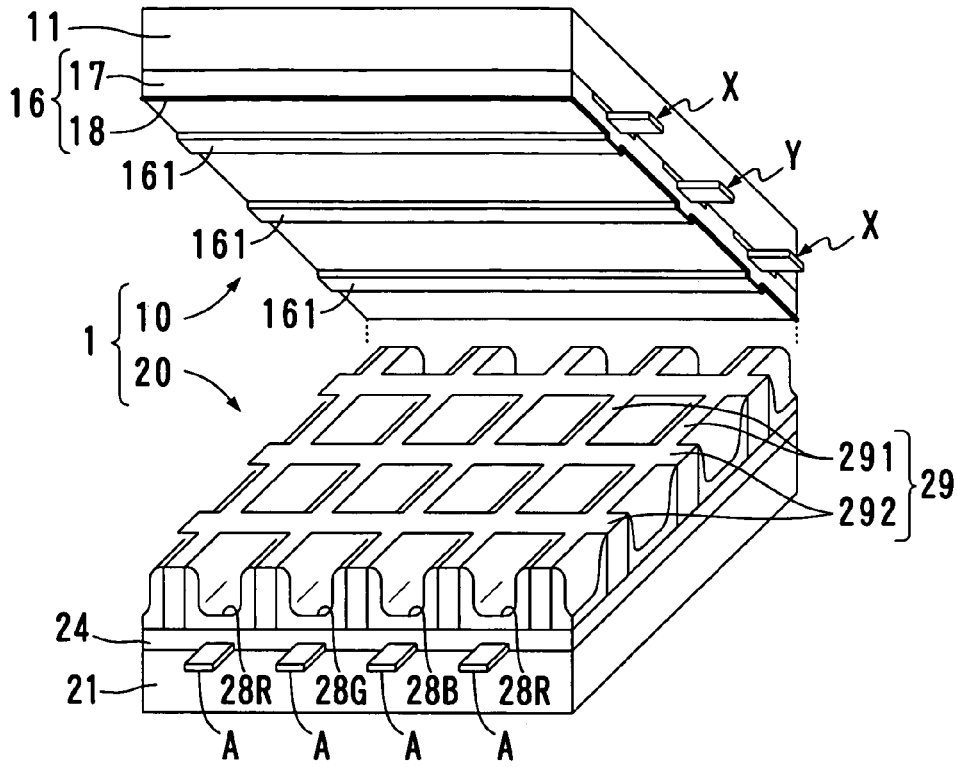
FIG. 4 shows an outline of a cell structure of a plasma display panel according to a first embodiment.
Figure 5:
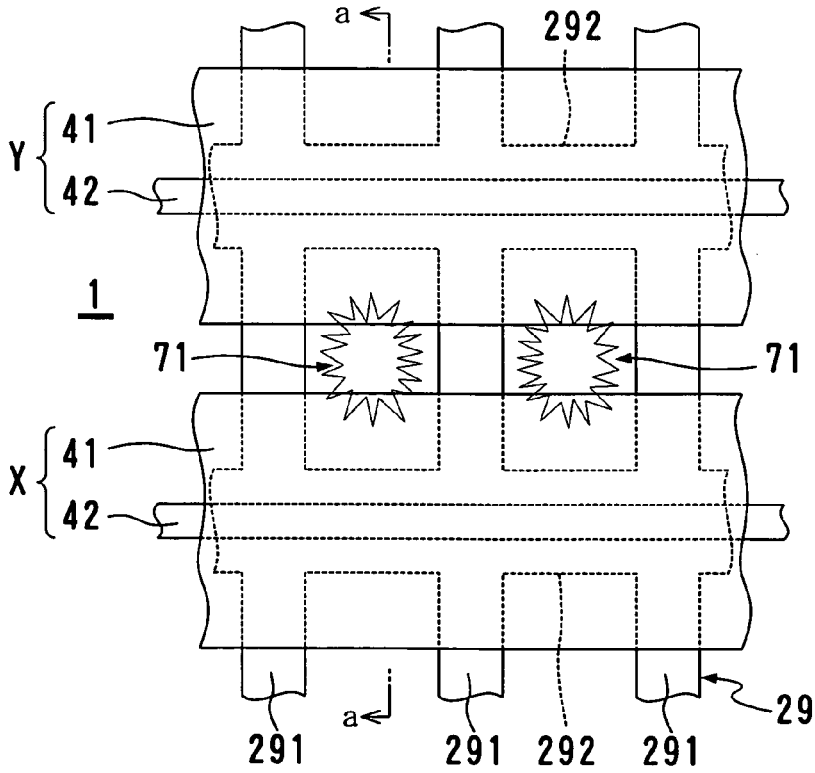
FIG. 5 shows planar shapes of display electrodes and a partition of the plasma display panel according to the first embodiment.

FIG. 4 shows an outline of a cell structure of a plasma display panel according to a first embodiment and FIG. 5 shows planar shapes of display electrodes and a partition. For easy understanding of an internal structure, FIG. 4 illustrates a cell structure with the front panel 10 being detached from the rear panel 20.

The front panel 10 of the plasma display panel 1 includes a glass substrate 11, the display electrodes X and Y and an insulation layer 16. The display electrodes X and Y are arranged on the glass substrate 11. Each of the display electrodes X and Y is made up of a transparent conductive film 41 having a wide ribbon shape and a metal film 42 having a narrow ribbon shape that is formed on the transparent conductive film 41 as shown in FIG. 5. The transparent conductive film 41 has a thickness of approximately several thousands Å and the metal film 42 has a thickness of approximately 3 μm through 4 μm. The metal film 42 has a thickness much greater than that of the transparent conductive film 41. The insulation layer 16 for covering the display electrodes X and Y is a layered film including a dielectric layer 17 and a protection film 18. The protection film 18 is a vapor-deposited film of magnesia with a thickness of approximately 0.5 μm. The insulation layer 16 has an uneven surface that reflects irregularities of a foundation surface in layer formation. The insulation layer 16 includes plural projections 161 corresponding to the metal film 42 of the display electrodes.

The rear panel 20 includes a glass substrate 21, address electrodes A, a dielectric layer 24, a partition 29 and three types of fluorescent material layers 28R, 28G and 28B having different light emission colors. As viewed from the top, the partition 29 is a grid-like structure in which plural vertical walls 291 for defining boundaries between columns are integral with plural horizontal walls 292 for defining boundaries between rows. The partition 29 divides a discharge gas space on a cell basis. The vertical walls 291 herein mean walls that extend from one end of the screen to the other end thereof in the vertical direction and have a linear shape as viewed from the top. The horizontal walls 292 herein mean walls that extend from one end of the screen to the other end thereof in the horizontal direction and have a linear shape as viewed from the top. Lattice point portions (four corners of a cell) in the partition 29 form a part of the vertical walls 291 and a part of the horizontal walls 292. Since the vertical wall 291 equals to the horizontal wall 292 in height, the horizontal walls 292 abut against the insulation layer 16 (more specifically, the projections 161 thereof).

As shown in FIG. 5, a set of a display electrode X and a display electrode Y that are adjacent to each other forms an electrode pair (an anode and a cathode) for generating a display discharge 71 in the form of surface discharge. Each of the display electrodes X and Y overlaps with a corresponding horizontal wall 292. The transparent conductive film 41 has a width greater than that of the horizontal wall 292 and overhangs equally both sides of the horizontal wall 292. In contrast, the metal film 42 has a width smaller than that of the horizontal wall 292 and overlaps with the middle portion of the horizontal wall 292 in the width direction. Stated differently, the horizontal wall 292 overhangs equally both sides of the metal film 42. It is a feature of the present invention that the horizontal wall 292 has a width greater than that of the metal film 42.

Figure 6:
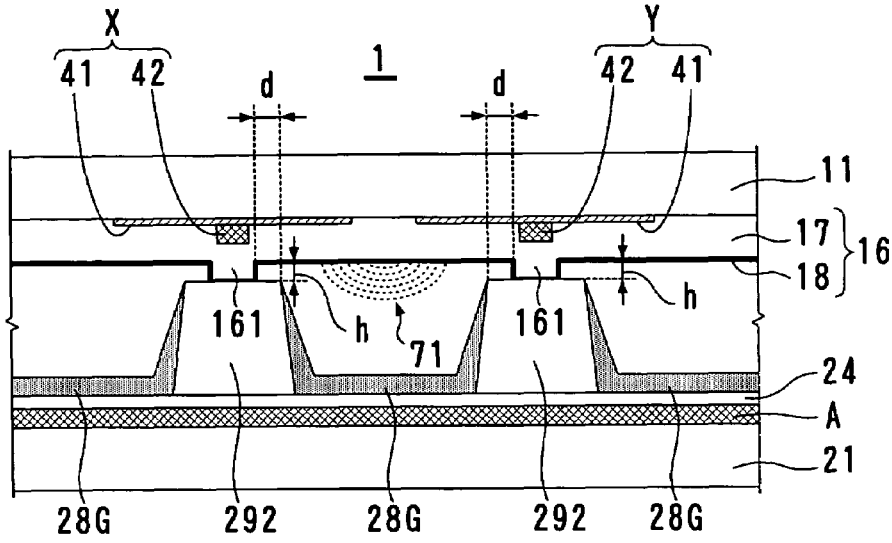
FIG. 6 is a diagram showing a cross-sectional structure of a substantial part of the plasma display panel according to the first embodiment.
Figure 7:
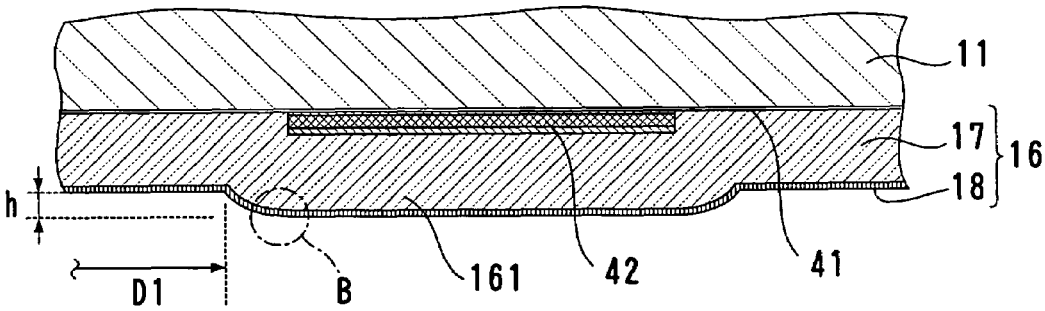
FIG. 7 is a diagram showing a cross-sectional shape of a projection of an insulation layer.
Figure 8:
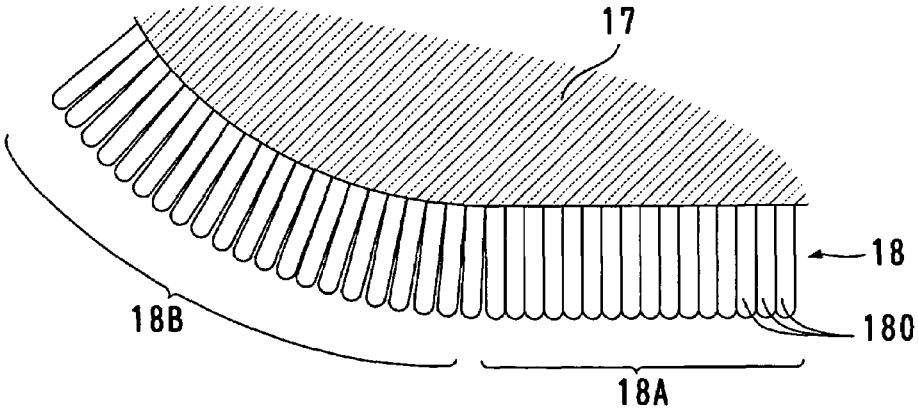
FIG. 8 is a schematic diagram showing a structure of a protection film.

FIG. 6 is a cross-sectional cut along a-a line in FIG. 5 and shows a cross-sectional structure of a substantial part of the plasma display panel according to the first embodiment. FIG. 7 is a diagram showing a cross-sectional shape of a projection of the insulation layer. FIG. 8 is an enlarged view of a portion B enclosed by a dot-dash line in FIG. 7 and schematically shows a structure of the protection film.

As described earlier, the insulation layer 16 has the projections 161 corresponding to the metal films 42 of the display electrodes X and Y. Such a structure of the insulation layer 16 is related to a method for forming the dielectric layer 17. The use of the vapor deposition method for forming the dielectric layer 17 provides an uneven surface of the dielectric layer 17, causing the thin protection film 18 for covering the dielectric layer 17 to be uneven. Strictly speaking, while uneven parts corresponding to the transparent conductive film 41 are generated, the uneven parts have a minute value that is unnecessary to be considered. Even in the case of using a thick film process, instead of the vapor deposition method, to form the dielectric layer 17, when a leveling process is insufficient at the time of burning, the surface of the dielectric layer 17 becomes uneven. The leveling process is apt to be insufficient in the case of using low melting point glass that adapts to lead-free and has a relatively high softening point as a material for the dielectric.

The width of the horizontal wall 292 that abuts against the projection 161 of the insulation layer 16 is greater than that of the projection 161. More specifically, the top surface of the horizontal wall 292 extends in the substrate surface direction with respect to the projection 161. The extended distance "d" is greater than the height "h" of the projection 161. Here, the height "h" is the height difference between the projection 161 of the insulation layer 16 and the vicinity thereof. In this example, the height "h" has a value equal to the thickness value of the metal film 42.

The horizontal wall 292 extends with respect to the projection 161, causing the vicinity of the projection 161 to narrow in a discharge gas space. A value of the distance "d" is greater than a value of the height "h" of the projection 161. Thereby, side surfaces (uneven surfaces) of the projection 161 are shielded from an electric field into which ions are drawn at the time of discharges.

To prevent sputtering for the side surfaces of the projection 161 contributes to improvement of an operating life. This is because the protection film 18 provided by deposition of magnesia is made up of many columnar crystals 180 that grow on the surface of the dielectric layer 17, as shown in FIG. 8. A section 18A that grows on a flat surface of the protection film 18 has uniform density in the film thickness direction and is a dense film matter. In contrast, in a section 18B that grows on a convex surface around the top of the projection 161, density of the columnar crystals is smaller as being closer to the surface layer. Gaps are generated microscopically among the columnar crystals near the surface layer. Such the less dense section 18B is inferior to the dense section 18A in sputtering resistance. Accordingly, sputtering for the section 18B is reduced and thereby it is possible to realize a life equal to the case where the entire protection film 18 is dense.

In order to confirm effects of the present invention, a plasma display panel 1 including the specifications mentioned below is manufactured by trial and a whole area continuous lighting test is performed with a sustain frequency of 60 kHz. This is an accelerated test in which a load almost six times ordinary television display is given.

Screen size: 42-inch

Discharge gas: 8% Xe—Ne

Gas pressure: 67 kPa

Dielectric layer: $Sio_2$ having a thickness of 8 μm (CVD deposition)

Protection film: MgO having a thickness of 5000 Å (vapor deposition)

The accelerated test result showed that a suitable operating time (i.e., an operating life) from the time when the test is started to the time when a lighting mistake exceeds a tolerance level is equal to or more than 14000 h.

As a comparative example, a similar accelerated test was performed on a plasma display panel having the same structure as the plasma display panel 1 except for the partition. More specifically, the plasma display panel as the comparative example has, as the partition 29, only vertical walls 291. The test result showed that a suitable operating time was 6000 h. This means that the operating life according to the first embodiment is 2.3 times that of the comparative example.

Another accelerated test was performed on a plasma display panel having, as the dielectric layer 17, lead-free low melting point glass with a thickness of 15 μm that is formed by the thick film process. The test result showed that the operating life of the plasma display panel of this type could be extended to 1.6 times or more that of the comparative example.

Second Embodiment

Figure 9:
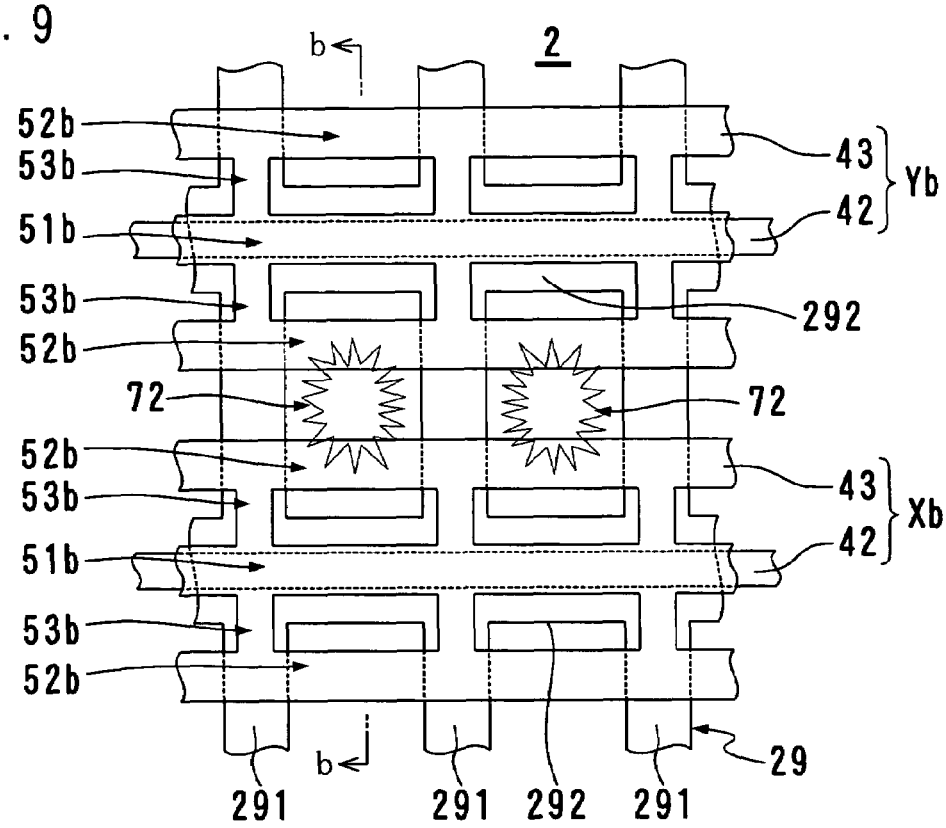
FIG. 9 shows planar shapes of display electrodes and a partition of a plasma display panel according to a second embodiment.
Figure 10:
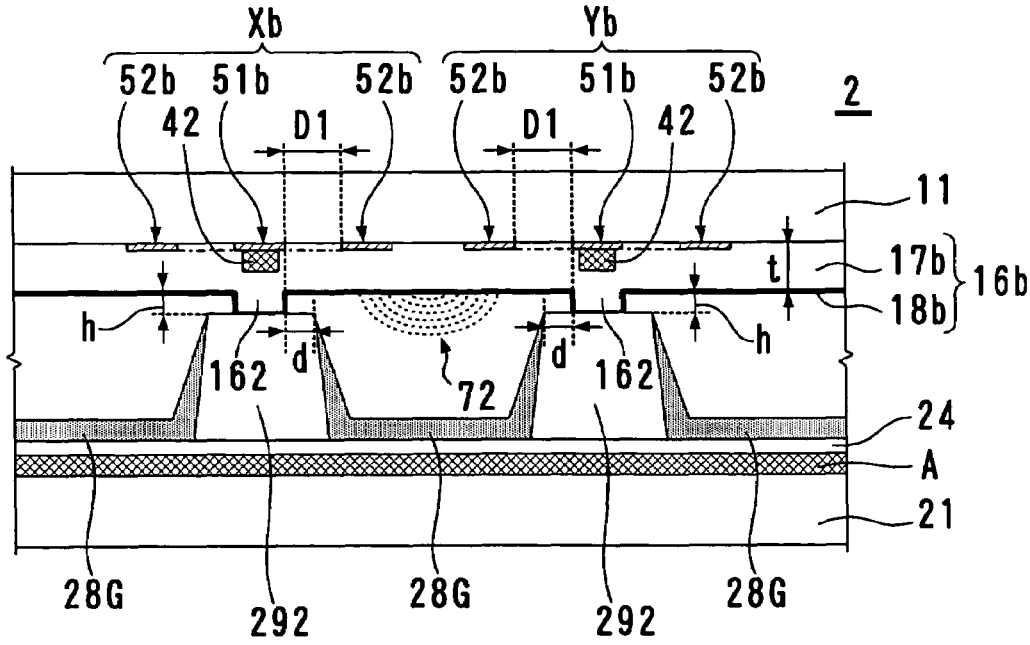
FIG. 10 is a diagram showing a cross-sectional structure of a substantial part of the plasma display panel according to the second embodiment.

FIG. 9 shows planar shapes of display electrodes of a plasma display panel according to a second embodiment. FIG. 10 shows a substantial part structure of a cross-section cut along b-b line in FIG. 9.

Each of display electrodes Xb and Yb of a plasma display panel 2 is structurally made up of a transparent conductive film 43 that has a wide ribbon shape with rectangular holes and a metal film 42 that is formed on the transparent conductive film 43 and has a narrow ribbon shape. The transparent conductive film 43 is patterned to have a shape in which three long horizontal ribbon parts are integral with short vertical ribbon parts. The long horizontal ribbon parts extend in the horizontal direction (in the row direction) and are arranged at regular intervals. The short vertical ribbon parts connect the horizontal ribbon parts together at positions where the vertical walls 291 overlap with the short vertical ribbon parts. The metal film 42 is, for example, a Cr—Cu—Cr thin film having a thickness of 3 μm through 4 μm and overlaps with the middle horizontal ribbon part out of the three horizontal ribbon parts of the transparent conductive film 43. Each of the display electrodes Xb and Yb is functionally made up of a power feeding trunk portion 51*b* with a ribbon shape that continuously extends over the entire length of a row, discharge portions 52*b* that form discharge surfaces in cells in the corresponding row and power feeding branch portions 53*b* each of which electrically connects the power feeding trunk portion 51*b* to the discharge portion 52*b*. The power feeding trunk portion 51*b* has the middle horizontal ribbon part of the transparent conductive film 43 and the metal film 42 overlapping therewith. The discharge portion 52*b* corresponds to two horizontal ribbon parts that are arranged at both ends out of the three horizontal ribbon parts of the transparent conductive film 43. The discharge portion 52*b* naturally has a thickness smaller than that of the power feeding trunk portion 51*b*. The power feeding branch portion 53*b* corresponds to the vertical ribbon part of the transparent conductive film 43.

Referring to FIG. 10, an insulation layer 16*b* for covering the display electrodes Xb and Yb is a layered film including a dielectric layer 17*b* and a protection film 18*b*. The dielectric layer 17*b* is formed by the vapor deposition method or the thick film process. The protection film 18*b* is a vapor-deposited film of magnesia with a thickness of approximately 0.5 μm. The insulation layer 16 has an uneven surface that reflects irregularities of a foundation surface in layer formation. The insulation layer 16*b* has plural projections 162 corresponding to the metal film 42 of the display electrodes. On the glass substrate 21 on the rear side are placed the address electrodes A, the dielectric layer 24, the partition 29 and three types of the fluorescent material layers 28R, 28G and 28B having different light emission colors, similarly to the case of the plasma display panel 1 described earlier. In FIG. 10, the horizontal walls 292 of the partition 29 are illustrated and the fluorescent material layers 28G, which has a green light emission color, of the fluorescent material layers 28R, 28G and 28B are illustrated.

The plasma display panel 2 is characterized in that the top surface of the horizontal wall 292 extends in the substrate surface direction with respect to the projection 162 by the distance "d" as in the case of the plasma display panel 1 described above. Further, the plasma display panel 2 is characterized in that the discharge portion 52*b* of each of the display electrodes Xb and Yb is away from the power feeding trunk portion 51*b* by the distance "D1". A value of the distance "D1" in the illustrated example is almost equal to a value of the thickness "t" of the insulation layer 16*b*. Here, the distance "t" is the shortest distance between an arbitrary position on the surface and the foundation surface (a surface of the substrate or the electrode). Stated differently, the thickness of the projection 162 is almost equal to the thickness at other positions in the insulation layer 16*b*.

The horizontal wall 292 extends with respect to the projection 162, causing sputtering for the uneven surface of the projection 162 to be reduced similarly to the case of the plasma display panel 1 described above. In addition, since the discharge portion 52*b* is away from the power feeding trunk portion 51*b*, a display discharge 72 is difficult to spread out in the uneven surface of the projection 162. In the plasma display panel 2, sputtering for the uneven surface of the projection 162 is definitely reduced compared to the case of the plasma display panel 1.

Third Embodiment

Figure 11:
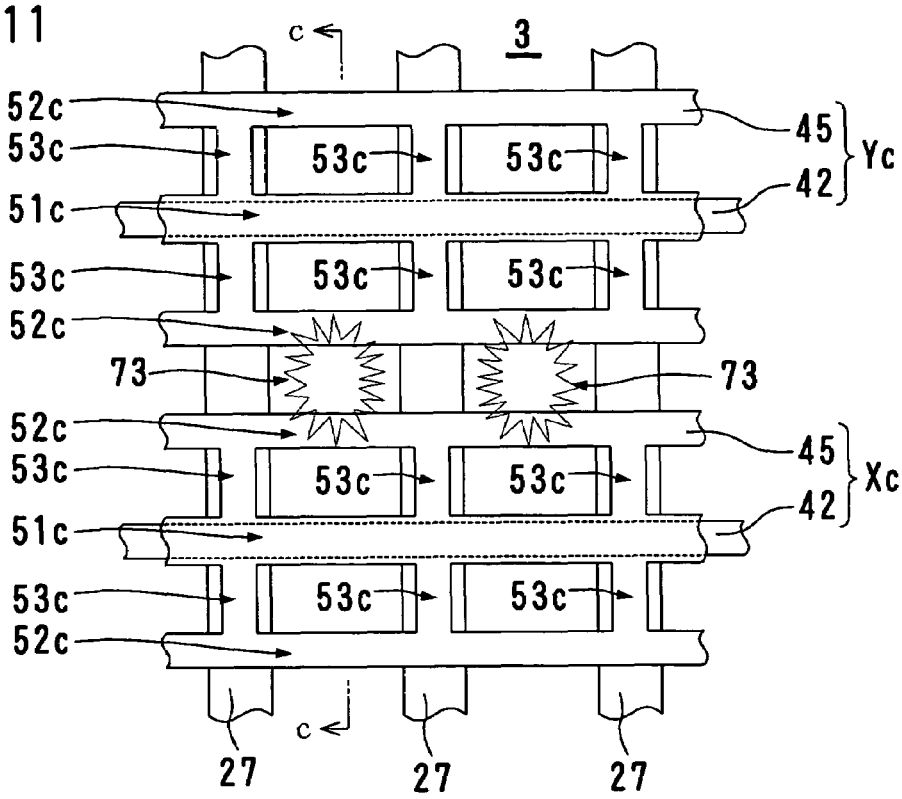
FIG. 11 shows planar shapes of display electrodes and a partition of a plasma display panel according to a third embodiment.
Figure 12:
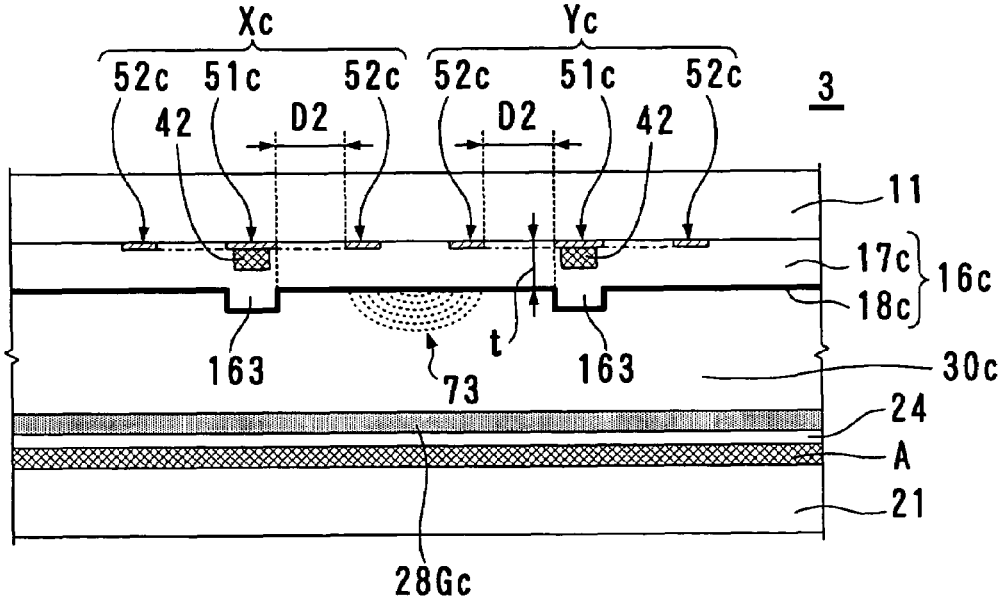
FIG. 12 is a diagram showing a cross-sectional structure of a substantial part of the plasma display panel according to the third embodiment.

FIG. 11 shows planar shapes of display electrodes and a partition of a plasma display panel according to a third embodiment. FIG. 12 shows a substantial part structure of a cross-section cut along c-c line in FIG. 11.

Display electrodes Xc and display electrodes Yc of a plasma display panel 3 have basically the same structure as those of the plasma display panel 2 according to the second embodiment. More specifically, each of the display electrodes Xc and Yc is structurally made up of a transparent conductive film 45 that has a wide ribbon shape with rectangular holes and a metal film 42 that is formed on the transparent conductive film 45 and has a narrow ribbon shape similarly to the case of the second embodiment. The transparent conductive film 45 is patterned to have a shape in which three long horizontal ribbon parts are integral with short vertical ribbon parts. The long horizontal ribbon parts extend in the horizontal direction (in the row direction) and are arranged at regular intervals. The short vertical ribbon parts connect the horizontal ribbon parts together at positions where a partition 27 overlaps with the short vertical ribbon parts. The metal film 42 overlaps with the middle horizontal ribbon part out of the three horizontal ribbon parts of the transparent conductive film 45. Each of the display electrodes Xc and Yc is functionally made up of a power feeding trunk portion 51*c* with a ribbon shape that continuously extends over the entire length of a row, a discharge portion 52*c* that forms discharge surfaces in cells in the corresponding row and a power feeding branch portion 53*c* that electrically connects the power feeding trunk portion 51*c* to the discharge portion 52*c*. The power feeding trunk portion 51*c* has the middle horizontal ribbon part of the transparent conductive film 45 and the metal film 42 overlapping therewith. The discharge portion 52*c* corresponds to two horizontal ribbon parts that are arranged at both ends out of the three horizontal ribbon parts of the transparent conductive film 45. The discharge portion 52*c* naturally has a thickness smaller than that of the power feeding trunk portion 51*c*. The power feeding branch portion 53*c* corresponds to the vertical ribbon part of the transparent conductive film 45.

In comparison with the second embodiment, the display electrodes Xc and Yc are characterized in that the distance "D2" between the discharge portion 52*c* and the power feeding trunk portion 51*c* is large.

Referring to FIG. 12, an insulation layer 16*c* for covering the display electrodes Xc and Yc is a layered film including a dielectric layer 17*c* and a protection film 18*c*. The dielectric layer 17*c* is formed by the vapor deposition method or the thick film process. The protection film 18*c* is a vapor-deposited film of magnesia with a thickness of approximately 0.5 μm. The insulation layer 16*c* has an uneven surface that reflects irregularities of a foundation surface in layer formation. The insulation layer 16*c* has plural projections 163 corresponding to the metal film 42 of the display electrodes. On the glass substrate 21 on the rear side are placed the address electrodes A, the dielectric layer 24, plural partitions 27 (not shown) and three types of fluorescent material layers having different light emission colors. In FIG. 12, a fluorescent material layer 28Gc having a green (G) light emission color is illustrated. The fluorescent material layer 28Gc is continuous over the entire length of a column.

Each of the plural partitions 27 in the plasma display panel 3 is a wall that defines boundaries between adjacent rows and has a linear shape as viewed from the top. Accordingly, as is apparent from FIGS. 11 and 12, no partitions are present that are opposed to the projections 163 of the insulation layer 16*c* in the middle of a column. The entire surfaces of the projections 163 are exposed to a discharge gas space 30*c*. Stated differently, uneven surfaces of the projections 163 are not hidden from display discharges 73. Instead, the discharge portion 52*c* of the display electrode is sufficiently away from the power feeding trunk portion 51*c* by the distance "D2". The metal film 42 on which the projections 163 are generated has a width equal to or smaller than the width of the power feeding trunk portion 51*c*. Accordingly, the discharge portion 52*c* is substantially away from the projection 163 in the substrate surface direction by nearly the distance "D2". A value of the distance "D2" is greater than that of the thickness "t" of the insulation layer 16*c*.

In the plasma display panel 3, the discharge portion 52*c* is sufficiently distanced from the uneven surface of the projection 163 and thereby sputtering for the uneven surface of the projection 163 is reduced.

An accelerated test was performed on the plasma display panel 3 according to the third embodiment as in the case of the first embodiment. The test result showed that a suitable operating time was equal to or more than 13000 h in the plasma display panel 3 having the dielectric layer 17*c* that is obtained by the CVD method.

In the embodiments described above, it is possible to form the metal film 42 for enhancing electrical conductivity of display electrodes, i.e., a bus conductor, by using the thick film process instead of using a thin film process. In such a case, the film thickness is 5 μm through 15 μm and the projection 161 or 162 of the insulation layer 16 or 16*b* has a height "h" almost equal to the film thickness. It is desirable that the value of the height "h" be small because it is harder for partitions to restrain sputtering with increasing the value of the height "h". With respect to a cell having a practical size equal to or less than 1 mm, partitions having an effect of restraining sputtering for projections can be placed, provided that the height "h" has a value equal to or less than 20 μm, more preferably equal to or less than 15 μm.

In the embodiments discussed above, descriptions are given to the case in which the insulation layer 16, 16*b* or 16*c* includes the projections 161, 162 or 163 corresponding to the metal film 42. However, application of the present invention is not limited to the case. The present invention can apply to, for example, a plasma display panel in which a pair of display electrodes is arranged for each row, an electrode gap between the adjacent electrode pairs is sufficiently large and a dark pigment layer with a thick ribbon shape for enhancing contrast is arranged in the electrode gap. In such a plasma display panel, the present invention can reduce sputtering for projections corresponding to the dark pigment layer in an insulation layer for covering display electrodes.

The insulation layer 16, 16*b* or 16*c* is not limited to a layered film including a dielectric layer 17, 17*b* or 17*c* and a protection film 18, 18*b* or 18*c*. The insulation layer 16, 16*b* or 16*c* can have a single layer structure, provided that a projection on a surface layer is a film matter having density lower than the other parts. The material for the surface layer of the insulation layer 16, 16*b* or 16*c* is not limited to magnesia. The present invention can apply to a structure in which a crystalline layer having density depending on undulation of a foundation layer is exposed to a discharge gas space, in addition to a structure in which the protection film 18, 18*b* or 18*c* is a layer made up of columnar crystals.

The present invention contributes to performance improvement of display devices.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. A plasma display panel comprising:

a first substrate;

a second substrate placed in face-to-face relation with the first substrate;

a plurality of row electrodes arranged on the first substrate; and an insulation layer for covering the row electrodes, the insulation layer having an uneven surface that reflects irregularities of a foundation surface and at least a surface layer portion of the insulation layer being made up of crystals of an insulation material, wherein a partition that abuts against the insulation layer is arranged on the second substrate, a top surface of the partition extends in a substrate surface direction with respect to a projection of the insulation layer that abuts against the partition, the top surface facing the insulation layer, and a distance of a part in the top surface of the partition is greater than a height difference between the projection of the insulation layer and vicinities of the projection, the part extending in the substrate surface direction with respect to the projection.

2. The plasma display panel according to claim 1, wherein the height difference is equal to or less than 20 μm.

3. The plasma display panel according to claim 1, wherein the insulation layer is a layered film including a dielectric layer and a protection film for covering the dielectric layer, and the protection film is a vapor-deposited film of magnesium oxide.

4. The plasma display panel according to claim 1, wherein each of the row electrodes includes a transparent conductive film and a metal film that is overlaid on the transparent conductive film and has a thickness greater than that of the transparent conductive film, and the projection is a portion of the insulation layer that covers the metal film.

5. The plasma display panel according to claim 1, wherein the partition is a wall that has a grid shape in a plan view and defines a boundary between adjacent columns and a boundary between adjacent rows, each of the row electrodes includes a ribbon-like power feeding trunk portion that continuously extends over an entire length of a corresponding row, a discharge portion that forms discharge surfaces in cells in the corresponding row and a power feeding branch portion that electrically connects the power feeding trunk portion to the discharge portion, and in each of the row electrodes, the discharge portion has a thickness smaller than that of the power feeding trunk portion, the power feeding trunk portion is away from the discharge portion in a column and the power feeding branch portion is placed to overlap with the partition in a plan view.

6. A plasma display panel comprising:

a first substrate;

a second substrate placed in face-to-face relation with the first substrate;

a plurality of row electrodes arranged on the first substrate; and an insulation layer for covering the row electrodes, the insulation layer having an uneven surface that reflects irregularities of a foundation surface and at least a surface layer portion of the insulation layer being made up of crystals of an insulation material, wherein each of the row electrodes includes a ribbon-like power feeding trunk portion that continuously extends over an entire length of a corresponding row, a discharge portion that is made of a conductive film having a thickness smaller than that of the power feeding trunk portion and forms discharge surfaces in cells in the corresponding row and a power feeding branch portion that electrically connects the power feeding trunk portion to the discharge portion, a plurality of partitions that defines a boundary between adjacent columns is arranged on the second substrate, and in each of the row electrodes, the discharge portion has a thickness smaller than that of the power feeding trunk portion, the power feeding trunk portion is spaced from the discharge portion at a distance greater than a thickness of the insulation layer and the power feeding branch portion is placed to overlap with the partition in a plan view.

* * * * *